US010967634B2

(12) United States Patent
Martin et al.

(10) Patent No.: US 10,967,634 B2
(45) Date of Patent: Apr. 6, 2021

(54) FLUIDIC DIE WITH DROP WEIGHT SIGNALS

(71) Applicant: HEWLETT-PACKARD DEVELOPMENT COMPANY, L.P., Spring, TX (US)

(72) Inventors: Eric Martin, Corvallis, OR (US); Daryl E Anderson, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/485,218

(22) PCT Filed: Apr. 14, 2017

(86) PCT No.: PCT/US2017/027596

§ 371 (c)(1),
(2) Date: Aug. 12, 2019

(87) PCT Pub. No.: WO2018/190863

PCT Pub. Date: Oct. 18, 2018

(65) Prior Publication Data

US 2020/0055309 A1 Feb. 20, 2020

(51) Int. Cl.
*B41J 2/045* (2006.01)

(52) U.S. Cl.
CPC ..... *B41J 2/0456* (2013.01); *B41J 2/0458* (2013.01); *B41J 2/04535* (2013.01);
(Continued)

(58) Field of Classification Search
CPC .. B41J 2/0456; B41J 2/04535; B41J 2/04541; B41J 2/0458; B41J 2/04581;
(Continued)

(56) References Cited

U.S. PATENT DOCUMENTS 9,010,899 B2 4/2015 Harjee et al.
9,289,978 B2 3/2016 Benjamin et al.
(Continued)

FOREIGN PATENT DOCUMENTS

CN 1190620 8/1998
CN 1389304 1/2003
(Continued)

OTHER PUBLICATIONS

HP High Definition Nozzle Architecture, 2016, <http://www8.hp.com/h20195/v2/GetPDF.aspx/4AA6-1075ENW.pdf >.

*Primary Examiner* — Henok D Legesse
(74) *Attorney, Agent, or Firm* — Dicke Billig & Czaja PLLC

(57) ABSTRACT

A fluidic die includes an array of nozzles, each nozzle to eject a fluid drop in response to a corresponding actuation signal having an actuation value. Nozzle select logic provides for each nozzle a nozzle select signal having a select value or a non-select value. Actuation logic provides the respective actuation signal for each nozzle, the actuation logic to receive one or more drop weight signals, and for each nozzle select signal having the select value, to provide an actuation signal having an actuation value to the corresponding nozzle and/or to one or more neighboring nozzles based on a state of the one or more drop weight signals.

15 Claims, 6 Drawing Sheets

(52) U.S. Cl.
CPC ..... *B41J 2/04541* (2013.01); *B41J 2/04581* (2013.01); *B41J 2/04583* (2013.01); *B41J 2/04568* (2013.01)

(58) Field of Classification Search
CPC ..... B41J 2/04583; B41J 2/04568; B41J 2/04543; B41J 2/04593
See application file for complete search history.

(56) References Cited

U.S. PATENT DOCUMENTS

| | | | | |
|---|---|---|---|---|
| 9,475,286 | B2 | 10/2016 | Tuttnauer et al. | |
| 9,511,584 | B2 | 12/2016 | Clark et al. | |
| 9,573,382 | B1 | 2/2017 | Metcalfe | |
| 2003/0169308 | A1 | 9/2003 | Audi et al. | |
| 2006/0061636 | A1 | 3/2006 | Moynihan | |
| 2008/0158276 | A1 | 7/2008 | Kubota | |
| 2011/0316918 | A1* | 12/2011 | Nagashima | B41J 2/14233 347/12 |
| 2015/0077451 | A1 | 3/2015 | Benjamin et al. | |
| 2015/0099059 | A1 | 4/2015 | Harjee et al. | |
| 2015/0266291 | A1* | 9/2015 | Hasegawa | B41J 2/04581 347/9 |
| 2018/0178511 | A1* | 6/2018 | Kashimura | B41J 2/04541 |
| 2019/0375207 | A1* | 12/2019 | Korthuis | B41J 2/20 |

FOREIGN PATENT DOCUMENTS

| | | |
|---|---|---|
| CN | 102209637 | 10/2011 |
| EP | 1419887 | 5/2004 |
| EP | 1935655 | 6/2008 |
| JP | H10016251 | 1/1998 |
| JP | 2004009334 | 1/2004 |
| JP | 2016172394 | 9/2016 |
| JP | 2016221912 A | 12/2016 |
| WO | WO-2015183275 A1 | 12/2015 |

* cited by examiner

FLUIDIC DIE WITH DROP WEIGHT SIGNALS

BACKGROUND

Fluidic dies may include an array of nozzles, where each nozzle includes a fluid chamber, a nozzle orifice, and a fluid actuator, where the fluid actuator may be actuated to cause displacement of fluid and cause ejection of a fluid drop from the nozzle orifice. Some example fluidic dies may be printheads, where the fluid may correspond to ink.

Figure 1:
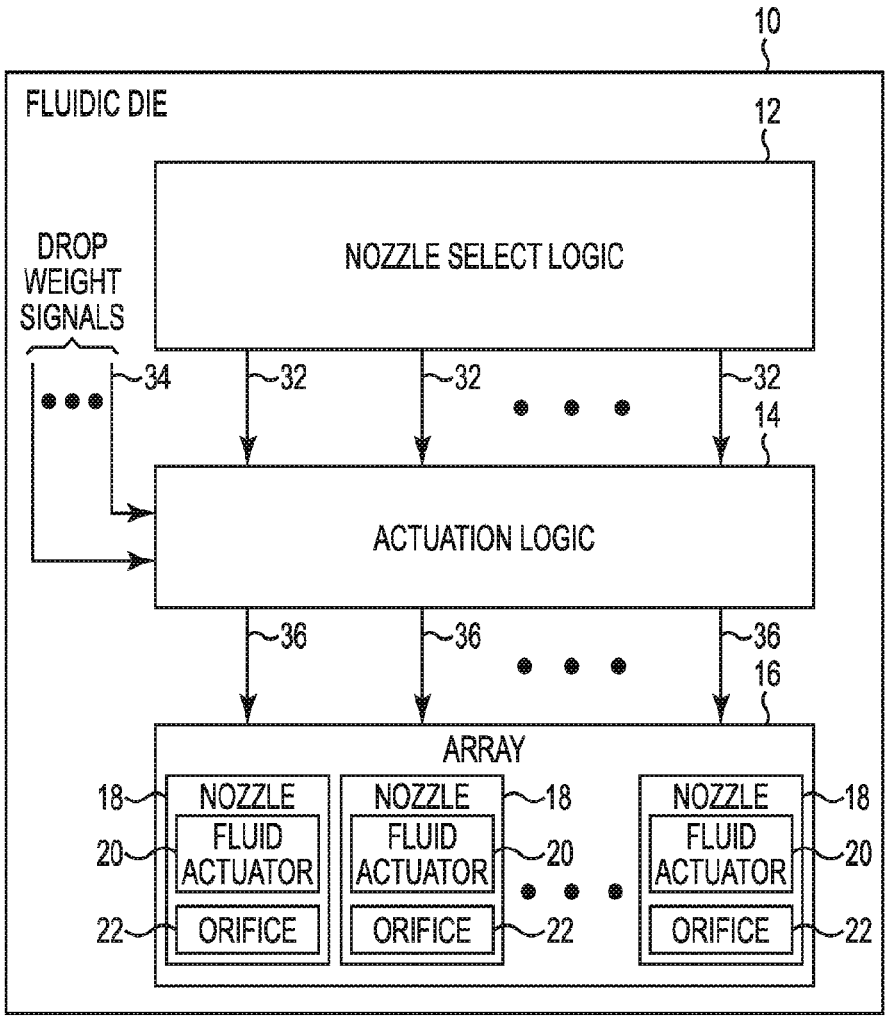
FIG. 1 is a block and schematic diagram illustrating a fluidic die according to one example.

Throughout the drawings, identical reference numbers designate similar, but not necessarily identical, elements. The figures are not necessarily to scale, and the size of some parts may be exaggerated to more clearly illustrate the example shown. Moreover the drawings provide examples and/or implementations consistent with the description; however, the description is not limited to the examples and/or implementations provided in the drawings.

DETAILED DESCRIPTION

In the following detailed description, reference is made to the accompanying drawings which form a part hereof, and in which is shown by way of illustration specific examples in which the disclosure may be practiced. It is to be understood that other examples may be utilized and structural or logical changes may be made without departing from the scope of the present disclosure. The following detailed description, therefore, is not to be taken in a limiting sense, and the scope of the present disclosure is defined by the appended claims. It is to be understood that features of the various examples described herein may be combined, in part or whole, with each other, unless specifically noted otherwise.

Examples of fluidic dies may comprise fluid actuators. The fluid actuators may include a piezoelectric membrane based actuator, a thermal resistor based actuator, an electrostatic membrane actuator, a mechanical/impact driven membrane actuator, a magneto-strictive drive actuator, or other such elements that may cause displacement of fluid responsive to electrical actuation. Fluidic dies described herein may comprise a plurality of fluid actuators, which may be referred to as an array of fluid actuators. Moreover, an actuation event, as used herein, may refer to concurrent actuation of fluid actuators of the fluidic die to thereby cause fluid displacement.

In example fluidic dies, the array of fluid actuators may be arranged in respective sets of fluid actuators, where each such set of fluid actuators may be referred to as a "primitive" or a "firing primitive." A primitive generally comprises a group of fluid actuators that each have a unique actuation address. In some examples, electrical and fluidic constraints of a fluidic die may limit which fluid actuators of each primitive may be actuated concurrently for a given actuation event. Therefore, primitives facilitate addressing and subsequent actuation of fluid ejector subsets that may be concurrently actuated for a given actuation event. A number of fluid ejectors corresponding to a respective primitive may be referred to as a size of the primitive.

To illustrate by way of example, if a fluidic die comprises four primitives, where each respective primitive comprises eight respective fluid actuators (each eight fluid actuator group having an address 0 to 7), and electrical and fluidic constraints limit actuation to one fluid actuator per primitive, a total of four fluid actuators (one from each primitive) may be concurrently actuated for a given actuation event. For example, for a first actuation event, the respective fluid actuator of each primitive having an address of 0 may be actuated. For a second actuation event, the respective fluid actuator of each primitive having an address of 1 may be actuated. As will be appreciated, the example is provided merely for illustration purposes. Fluidic dies contemplated herein may comprise more or less fluid actuators per primitive and more or less primitives per die.

Some example fluidic dies comprise microfluidic channels. Microfluidic channels may be formed by performing etching, microfabrication (e.g., photolithography), micromachining processes, or any combination thereof in a substrate of the fluidic die. Some example substrates may include silicon based substrates, glass based substrates, gallium arsenide based substrates, and/or other such suitable types of substrates for microfabricated devices and structures. Accordingly, microfluidic channels, chambers, orifices, and/or other such features may be defined by surfaces fabricated in the substrate of a fluidic die. Furthermore, as used herein a microfluidic channel may correspond to a channel of sufficiently small size (e.g., of nanometer sized scale, micrometer sized scale, millimeter sized scale, etc.) to facilitate conveyance of small volumes of fluid (e.g., picoliter scale, nanoliter scale, microliter scale, milliliter scale, etc.). Example fluidic dies described herein may comprise microfluidic channels in which fluidic actuators may be disposed. In such implementations, actuation of a fluid actuator disposed in a microfluidic channel may generate fluid displacement in the microfluidic channel. Accordingly, a fluid actuator disposed in a microfluidic channel may be referred to as a fluid pump.

In some examples, a fluid actuator may be disposed in a nozzle, where the nozzle may comprise a fluid chamber and a nozzle orifice in addition to the fluid actuator. The fluid actuator may be actuated such that displacement of fluid in the fluid chamber may cause ejection of a fluid drop via the nozzle orifice. Accordingly, a fluid actuator disposed in a nozzle may be referred to as a fluid ejector.

Fluidic dies may include an array of nozzles (such as columns of nozzles, for example), where fluid drops (such as ink drops, for example) are selectively ejected from nozzles by selective operation of the respective fluid actuators. Individual nozzles of a fluidic die are typically of a same size (e.g., same chamber and nozzle orifice sizes) and eject fluid drops of a fixed volume or fixed weight. However, it may be desirable for a fluidic die to be able to eject fluid drops of different drop weights at different times. In order to do so, some fluidic dies employ nozzles of different sizes which eject fluid drops having different fixed drop weights. For example, some fluidic dies may include nozzles of two different sizes which are arranged in an alternating fashion in an array, where smaller sized nozzles may be selected to eject fluid drops when smaller drop weights are desired, and larger sized nozzles may be selected when larger drop weights are desired. While such a configuration enables a fluidic die to eject fluid drops of different weights, by including larger sized nozzles, the number of smaller sized nozzles able to be disposed on the fluid die is reduced, thereby reducing the resolution of fluidic die.

FIG. 1 is a block and schematic diagram illustrating some components of a fluidic die 10 according to one example. As will be described in greater detail below, according to one example, fluidic die 10 employs drop weight signals to control a nozzle and/or one or more neighboring nozzles to simultaneously eject fluid drops such that the fluid drops combine or merge in flight or on a target surface to effectively produce a larger fluid drop than a fluid drop ejected by a single nozzle. The combined fluid drop, either in the air or on a target surface, may be referred to herein as having an "effective drop weight" or as being an "effective fluid drop". By varying the number of neighboring nozzles which simultaneously eject a fluid drop, the effective drop weight of fluid drops provided by fluidic die 10 can be selectively varied by the drop weight signals. As employed herein, the term "drop weight" refers to a volume of a fluid drop, and may sometimes also be referred to as "drop size".

Figure 3:
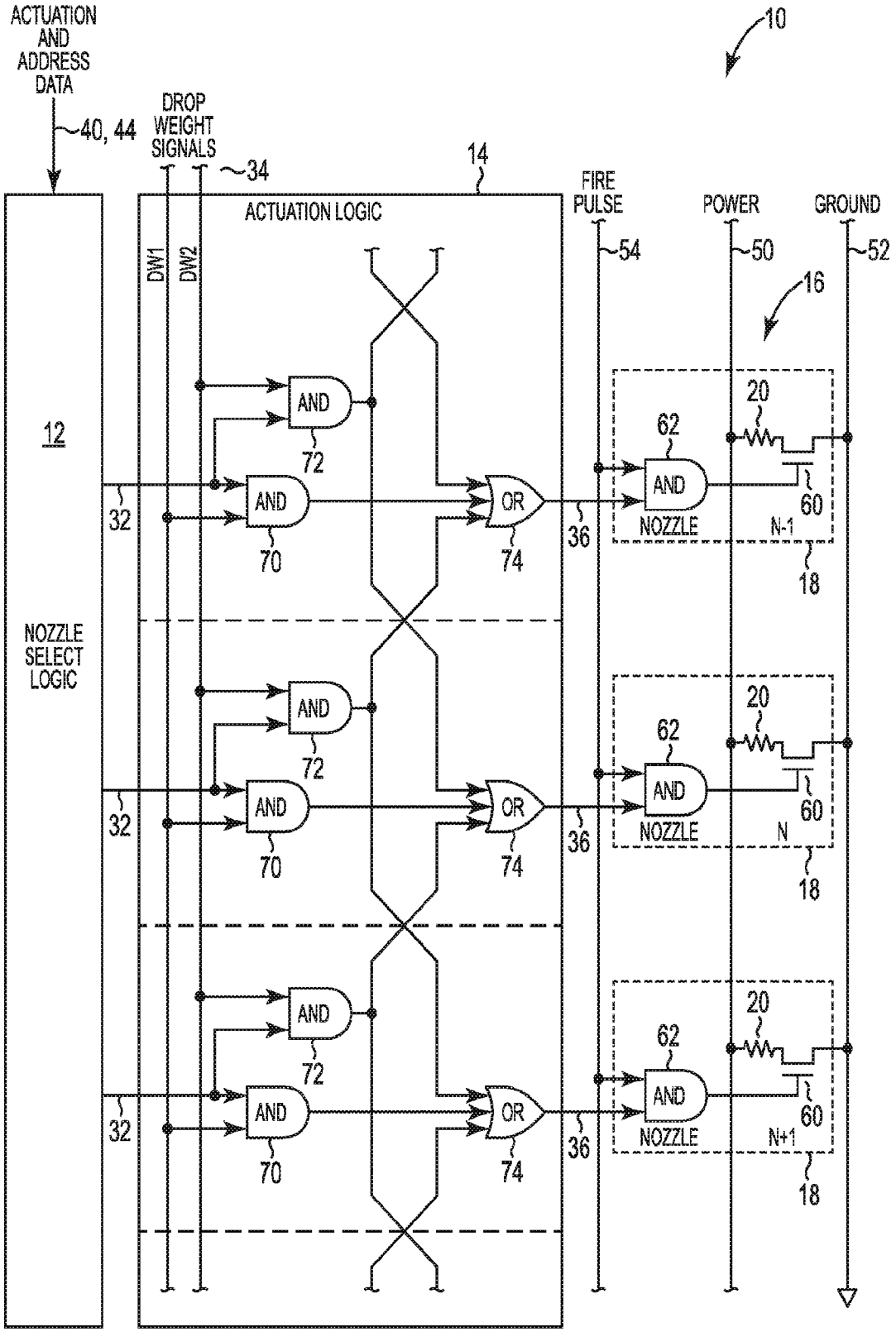
FIG. 3 is a block and schematic diagram illustrating a fluidic die according to one example.

In the illustrative example of FIG. 3, fluidic die 10 includes nozzle select logic 12, actuation logic 14, and an array 16 of nozzles 18, with each nozzle 18 including a fluid actuator 20 and a nozzle orifice 22, and each nozzle configured to selectively eject fluid drops through nozzle orifice 22 via actuation of fluid actuator 20. In one example, each nozzle 18 is configured to eject fluid drops having a same fixed drop weight. In one example, nozzles 18 of array 16 may be arranged so to form one or more columns of nozzles 18.

According to one example, nozzle select logic 12 provides nozzle select signals 32 for selecting which nozzles 18 of array 16 are to eject fluid drops during an actuation event. In one instance, nozzle select logic 12 provides a nozzle select signal 32 for each nozzle 18, each nozzle select signal 32 having either a select value (e.g., a "1") when a nozzle is selected for actuation, or a non-select value (e.g., a "0") when a nozzle is to be inactive during an actuation event.

Actuation logic 14 receives nozzle select signals 32 from nozzle select logic 12, and receives one or more drop weight signals 34, where states of the drop weight signals 34 are indicative of a selected effective drop weight of fluid drops to be ejected by array 16 during an actuation event. In one example, each drop weight signal 34 has an enable state or a disable state (e.g., a "1" or a "0"). In one example, a single drop weight signal 34 may be received. In other examples, more than one drop weight signal 34 may be received, such as two (or more) drop weight signals 34.

Actuation logic 14 provides actuation signals 36 to array 16 to control the activation of fluid actuators 20 of nozzles 18 to eject fluid drops. In one example, actuation logic 14 provides an actuation signal 36 for each nozzle 18 to control activation of the corresponding fluid actuator 20. In one example, each actuation signal has an actuation value (e.g., a "1") or a non-actuation value (e.g., a "0"), with an actuation value causing the fluid actuator 20 of the corresponding nozzle 18 to eject a fluid drop.

In one example, for each nozzle 18 having a corresponding nozzle select signal 32 having a select value (e.g., a value of "1"), actuation logic 14 provides an actuation signal 36 having an actuation value to the corresponding nozzle 18 (the so-called "target" nozzle) and/or to one or more neighboring nozzles 18 based on the states of drop weight signals 34 (e.g., one or more drop weight signals 34), so as to cause the target nozzle 18 and/or the one or more neighboring nozzles 18 to eject fluid drops. When more than more than one nozzle 18 eject a fluid drop (e.g., the target nozzle and one or more neighboring nozzles), the fluid drops merge either in flight or on a target surface (e.g., a print media when fluidic die 10 comprises a printhead) to form or have the effect of a single, larger fluid drop. By selectively varying a number of nozzles simultaneously ejecting fluid drops in response to a given nozzle select signal 32 based on the states of drop weight signals 34, the effective drop weight of effective fluid drops provided by fluidic die 10 can be selectively varied while maintaining a high output resolution for the fluidic die 10.

For instance, in one example, as will be described in greater detail below, nozzles 18 may be arranged in a column, with two drop weight signals 34 being received, where one drop weight signal is a so-called "actuate self" signal and the other drop weight signal is a so-called "actuate neighbors" signal. For a given nozzle select signal 32 having a select value, actuation logic 14 provides an actuation signal 36 having an actuation value to only the fluid actuator 20 of the nozzle 18 corresponding to the given nozzle select signal 32 (i.e., the target nozzle) when the "actuate self" drop weight signal has the enable state and the "actuate neighbors" drop weight signal has the disable state, thereby resulting in the target nozzle ejecting a single fluid drop having a first drop weight.

In another example, for a given nozzle select signal 32 having a select value, activation logic 14 provides actuation signals 36 having an actuation value to only the fluid actuators 20 of two neighboring nozzles 18 (e.g., the nozzles 18 immediately above and below the target nozzle in the column of nozzles) and not to the target nozzle itself when the "actuate self" drop weight signal has the disable state and the "actuate neighbors" drop weight signal has the enable state, thereby resulting in the ejection of two fluid drops that merge to effectively form a fluid drop (an "effective fluid drop") having a second drop weight.

Continuing with the above example, for a given nozzle select signal 32 having a select value, activation logic 14 provides actuation signals 36 having an actuation value to the fluid actuator 20 of the target nozzle and to the fluid actuators 20 of two neighboring nozzles 18 when the "actuate self" drop weight signal and the "actuate neighbors" drop weight signal each have the enable state, thereby resulting in the ejection of three fluid drops that merge to form an effective fluid drop having a third drop weight.

The above implementation illustrates an example where, in addition to a selected or target nozzle, two neighboring nozzles may be actuated in order for fluidic die 10 to provide effective fluid drops having three drop weights. In other examples, in addition to the target nozzle, more than two neighboring nozzles may be employed to produce fluid drop weights having any number of selectable drop weights (e.g., a $4^{th}$ drop weight, a $5^{th}$ drop weight etc.), so long as the nozzles are arranged close enough to one another on fluidic die 10 so that their ejected fluid drops merge together either in the air or on a target surface to have the effect of a single, larger fluid drop (i.e., an "effective" fluid drop). In one example, each of the nozzles 18 may eject a fluid drop having a same drop weight (a so-called "base drop weight"), such that selected effective drop weights may be multiples of the base drop weight.

Figure 2:
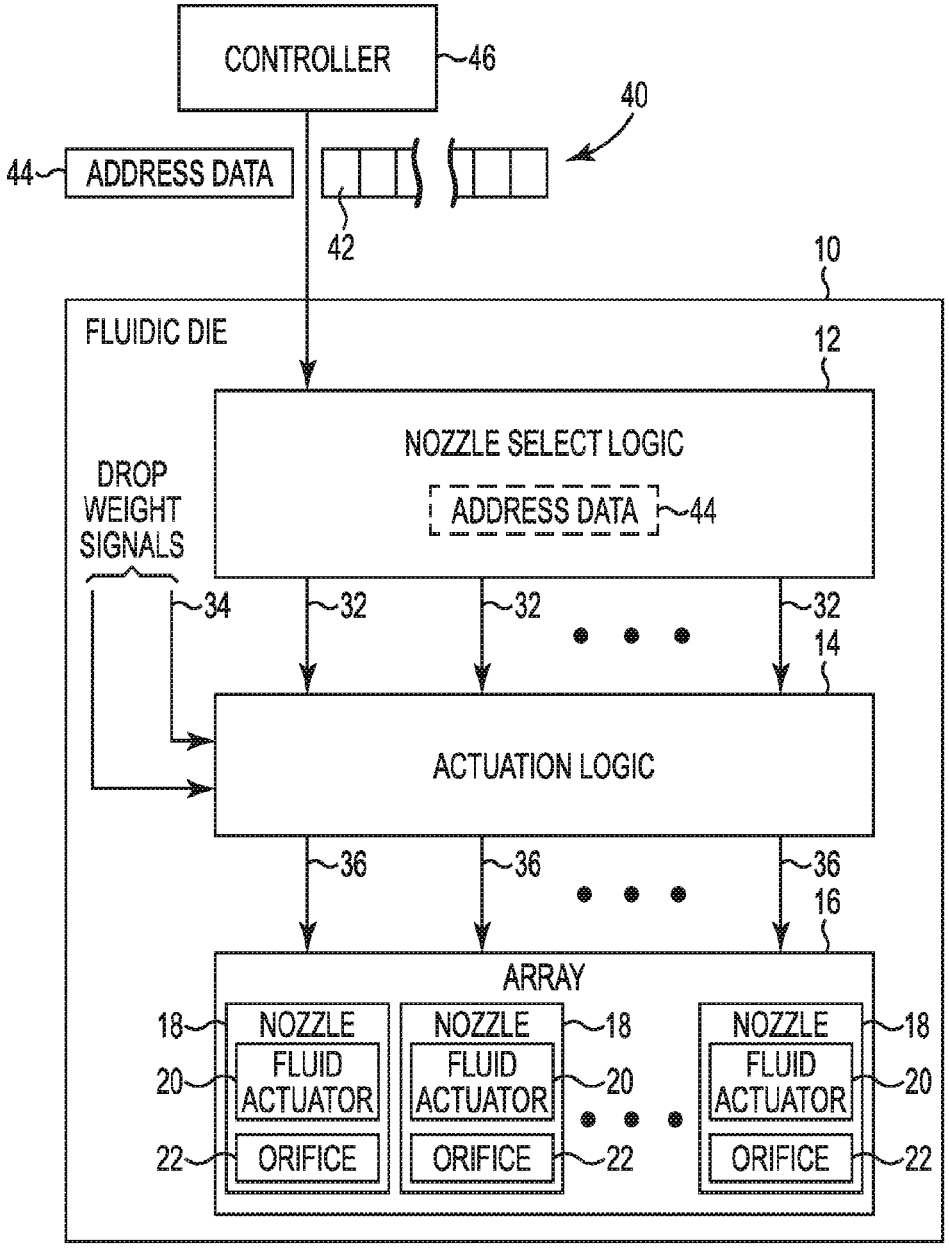
FIG. 2 is a block and schematic diagram illustrating a fluidic die according to one example.

With reference to FIG. 2, according to one example, nozzle select logic 12 receives actuation data 40, such as from a controller 46, where actuation data 40 includes a plurality of actuation data bits 42, each actuation data bit 42 corresponding to a different one of the nozzles 18, and each actuation data bit 42 having an actuation value (e.g., a value of "1") or a non-actuation value (e.g., a value of "0"). In one example, nozzle select logic 12 further receives address data 44 corresponding to each nozzle 18, the address data for each nozzle 18 having an enable value or a non-enable value indicative of whether the nozzle 18 is enabled for ejection of fluid drops during a given actuation event. In other examples, address data 44 may be internally generated by fluidic die 10, such as by nozzle select logic 12 (as indicated by the dashed lines in FIG. 2).

In one example, nozzle select logic 12 provides for each nozzle 18 a nozzle select signal 32 having the select value (e.g., a value of "1") when the corresponding address data 30 has the enable value and the corresponding actuation data bit 26 has the actuation value, and a nozzle select signal 32 having the non-select value (e.g., a value of "0") when the corresponding address data 30 has the non-enable value or the corresponding address bit 26 has the non-actuation value.

FIG. 3 is a block and schematic diagram illustrating portions of a fluidic die 10, including an example of actuation logic 14, in accordance with one instance of the present disclosure. In the example of FIG. 3, nozzles 18 of array 16 are arranged to form a column, with a portion of such column being illustrated by nozzles N, N−1, and N+1, with nozzles N−1 and N+1 representing immediately adjacent "neighbors" of nozzle N (i.e., the nozzles immediately on each side of nozzle N). While only three nozzles 18 are illustrated (N−1, N, N+1), in other instances, a column may include more than three nozzles, and array 16 may include than one column of nozzles.

In one example, each nozzle 18 includes a fluid actuator 20 (e.g., a thermal resistor, sometimes referred to as a firing resistor) coupled between a power line 50 and a ground line 52 via an activation device, such as a controllable switch 60 (e.g., a field effect transistor (FET)), which is controlled via an output of a corresponding AND-gate 62.

According to one example, for each nozzle 18, actuation logic 14 includes a corresponding first AND-gate 70, a second AND-gate 72, and an OR-gate 74. As described above, actuation logic 14 receives drop weight signals 34, such as drop weight signal DW1 and DW2, and receives a plurality of nozzle select signals 32 from nozzle select logic 12, one nozzle select signal 32 corresponding to each of the nozzles 18 of array 16. Although illustrated in FIG. 3 as receiving two drop weight signals 34, DW1 and DW2, in other instances, fewer than two (i.e., one) or more than two (e.g., three, four, etc.) drop weight signals may be received. As described in greater detail below, a number of drop weight signals employed depends on a number of of drop weights which can be selected for an effective fluid drop (e.g., $1^{st}$, $2^{nd}$, $3^{rd}$, $4^{th}$ drop weights, etc.) to be ejected from fluidic die 10.

For each nozzle 18, AND-gate 70 has inputs coupled to the corresponding nozzle select signal 32 and to drop weight signal, DW1, and an output provided as an input to OR-gate 74. Additionally, AND-gate 72 has inputs coupled to the corresponding nozzle select signal 32 and to the other drop weight signal, DW2, with an output provided as an input to OR-gates 74 of each of the neighboring nozzles, in this case, nozzles N−1 and N+1. For example, the output of AND-gate 72 corresponding to nozzle N is coupled as an input to OR-gate 74 of neighboring nozzle N−1 and as an input to OR-gate 74 of neighboring nozzle N+1 of column 16, such that AND-gate 72 is cross-coupled to OR-gates of the neighboring nozzles.

An example of the operation of fluidic die 10 of FIG. 3 is described below with regard to the operation of nozzle N. As described above, each drop weight signal DW1 and DW2 has enable state (e.g., a "1") and a disable state (e.g., a "0"), with drop weight signals DW1 and DW2 respectively being referred to as "enable self" and "enable neighbors" signals.

Referring to nozzle N, and with further reference to FIG. 2, when address data 44 corresponding to nozzle N has an enable value and an actuation data bit 42 corresponding to nozzle N has an actuation value (e.g. a value of "1"), nozzle select logic 12 provides nozzle select signal 32 having a select value (e.g., a value of "1") to both AND-gate 70 and AND-gate 72 corresponding to nozzle N. If drop weight signal DW1 has an enable state (e.g., a value of "1") and drop weight DW2 has a disable state (e.g., a value of "0"), AND-gate 70 provides an active output having a "HI" value (e.g., a value of "1") to OR-gate 74 associated with nozzle N while AND-gate 72 provides an inactive output having a "LO" value (e.g., a value of "0") to the OR-gates 74 of neighboring nozzles N−1 and N+1. As a result, OR-gate 74 associated with nozzle N, in conjunction with fire pulse signal 54, results in a "HI" output from AND-gate 62 of nozzle N causing controllable switch 60 to activate fluid actuator 20 to eject a fluid drop, while controllable switches 60 of neighboring nozzles N−1 and N+1 are not activated by corresponding OR-gates 72 so that fluid actuators 20 of neighboring nozzles N−1 and N+1 do not eject fluid drops.

As such, when drop weight signal DW1 has an enable state and drop weight signal DW2 has a disable state, only nozzle N ejects a fluid drop in response to select signal 32 of nozzle N having a select value, resulting in a effective fluid drop having a first drop weight being ejected by fluidic die 10. It is noted that even though neighboring nozzles N−1 and N+1 do not eject fluid drops in response to AND-gate 72 of nozzle N having a "HI" output, nozzles N−1 and N+1 may still eject fluid drops in response to their own corresponding nozzle select signal 32 having a select value and drop weight signal DW1 having an active value.

When nozzle select signal 32 of nozzle N has a select value (e.g., a value of "1"), drop weight signal DW1 has a disable state, and drop weight signal DW2 has an enable state, AND-gate 70 associated with nozzle N provides a "LO" output to OR-gate 74 of nozzle N, and AND-gate 72 provides a "HI" output to the OR-gates 74 of neighboring nozzles N−1 and N+1. As a result, OR-gate 74 of nozzle N provides a "LO" output to AND-gate 62 of nozzle N, while OR-gates 74 of neighboring nozzles N−1 and N+1, in conjunction with fire pulse signal 54, result in "HI" outputs being provided by AND-gates 62 of nozzles N−1 and N+1, causing controllable switches 60 of neighboring nozzles N−1 and N+1 to actuate fluid actuators 20 to eject fluid drops, while fluid actuator of nozzle N is inactive.

As such, when drop weight signal DW1 has a disable state and drop weight signal DW2 has an enable state, only neighboring nozzles N−1 and N+1 eject fluid drops in response to select signal 32 of nozzle N having a select value. Such fluid drops merge, either in the air or on a surface, resulting in a effective fluid drop having a second drop weight being ejected by fluidic die 10.

When nozzle select signal 32 of nozzle N has a select value (e.g., a value of "1"), and both drop weight signal DW1 and drop weight signal DW2 have an enable state, AND-gate 70 associated with nozzle N provides a "HI"

output to OR-gate 74 of nozzle N, and AND-gate 72 provides a "HI" output to the OR-gates 74 of neighboring nozzles N−1 and N+1. As a result, OR-gates 74 of nozzles N, N−1, and N+1, in conjunction with fire pulse signal 54, result in "HI" outputs from AND-gates 62 of nozzles N, N−1, and N+1, causing controllable switches 60 of nozzles N−1 and N+1 to actuate fluid actuators 20 to eject fluid drops.

As such, when drop weight signals DW1 and DW2 each have an enable state, nozzle N and neighboring nozzles N−1 and N+1 each eject fluid drops in response to select signal 32 of nozzle N having a select value. Again, such fluid drops merge, either in the air or on a surface, resulting in an effective fluid drop having a third drop weight being ejected by fluidic die 10.

Although the example activation logic 14 of FIG. 3 is illustrated as "cross-connecting" a nozzle with two neighboring nozzles (e.g., cross-connecting nozzle N with immediately adjacent neighbors N−1 and N+1) to provide up to three fluid drop weights from which to select, in other examples, activation logic 14 and fluidic die 10 can be arranged so that more than or fewer than two neighboring nozzles can be cross-connected with the selected nozzle. When more than two neighboring nozzles are cross-connected to a nozzle (e.g., three, four, five neighboring nozzles, etc.), it is noted that actuation logic 14 may be configured to include additional logic gates for each nozzle (e.g. additional AND-gates and Or-gates), and additional drop weight signals 34. In other examples, neighboring nozzles 18 are not required to include nozzles immediately adjacent to a selected nozzle.

Figure 4:
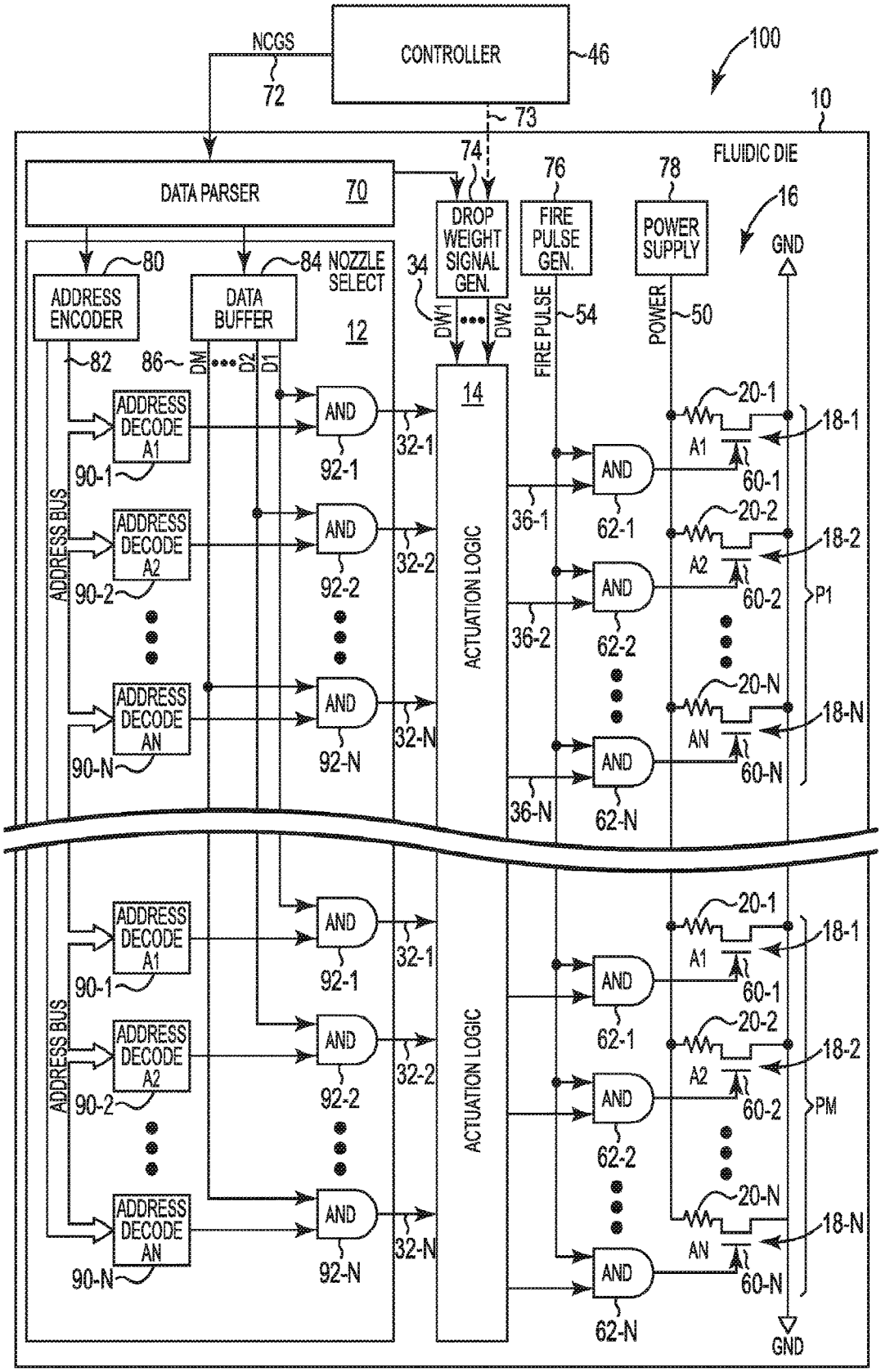
FIG. 4 is a block and schematic diagram illustrating a fluid ejection system including a fluidic die, according to one example

FIG. 4 is a block and schematic diagram generally illustrating portions of a fluid ejection system 100 including a controller 46 and fluidic die 10 having an array 16 of nozzles 18, and employing drop weight signals 34 and activation logic 14 (such as activation logic 14 of FIG. 3, for example) for selectively varying an effective drop weight of fluid drops ejected by array 16, according to one example. As noted below, fluid ejection system of FIG. 4 represents one example, and any suitable nozzle configuration and suitable nozzle select scheme may be employed in lieu of that illustrated by FIG. 4.

In the example of FIG. 4, array 16 includes a column of nozzles 18 grouped to form a number of primitives, illustrated as primitives P1 to PM, with each primitive including a number of nozzles, illustrated as nozzles 18-1 to 18-N, with each nozzle including a fluid actuator 20, a controllable switch 60, and a corresponding AND-gate 62. Each primitive, P1 to PM, has a same set of addresses, illustrated as addresses A1 to AN, with each address corresponding to a respective one of the nozzles P1 to PM.

Fluidic die 10 includes a data parser 70 which, according to the example of FIG. 4, receives data in the form of NCGs (nozzle column groups) from controller 46 via a data path 72, where NCGs, as will be described in greater detail below (see FIGS. 5 and 6) include actuation data and address data for nozzles 18 and drop weight data for selecting fluid drop weights via drop weight signals 34 and actuation logic 14. Fluidic die 10 further includes a drop weight signal generator 74 to generate drop weight signals 34 (e.g., drop weight signals DW1 and DW2) based on drop weight data received from data parser 70, a fire pulse generator 76 to generate fire pulse 54, and a power supply 78 to supply power to power line 50.

In one example, nozzle select logic 12 includes an address encoder 80 which encodes addresses of the set of addresses of primitives P1 to PM, as received via data parser 70 from controller 46, onto an address bus 82. A data buffer 84 places actuation data for nozzles 18, as received via data parser 70 from controller 46, onto a set of data lines 86, illustrated as data lines D1 to DM, with one data line corresponding to each primitive P1 to PM. For each nozzle 18-1 to 18-N of each primitive P1 to PM, nozzle select logic 12 includes a corresponding address decoder 90 to decode the corresponding address, illustrated as address decoders 90-1 to 90-N, and a corresponding AND-gate 92, illustrated as AND-gates 92-1 to 92-N, the output of which represents the nozzle select signal 32 for the corresponding nozzle, and being illustrated as nozzle select signals 32-1 to 32-N.

In operation, according to one example, controller 46 provides operational data, including nozzle address data, nozzle actuation data, and drop weight data, to fluidic die 10 in the form of a series of NCG's to cause nozzles 18 of fluidic die 10 to eject fluid drops to provide effective fluid drops of selected effective drop weights in a desired pattern.

Figure 5:
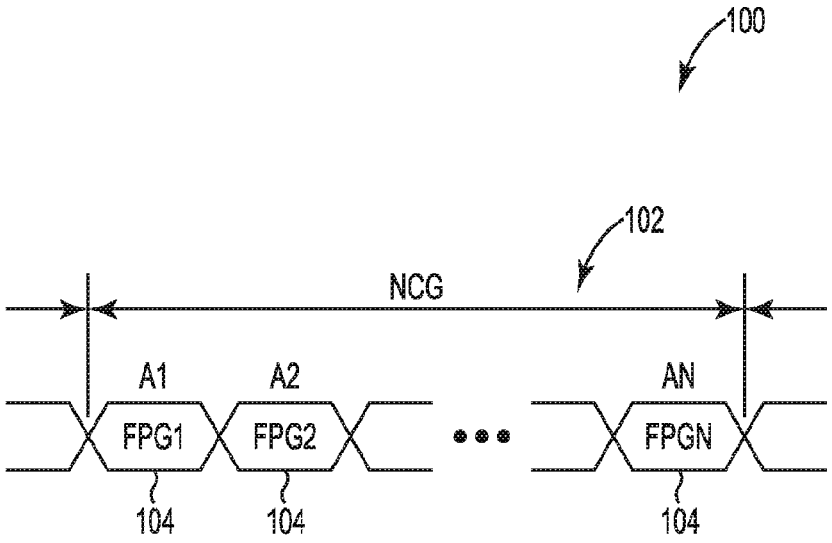
FIG. 5 is a block and schematic diagram generally illustrating an example nozzle column group.

FIG. 5 is a block diagram generally illustrating a portion of a series 100 of NCGs 102 defining an actuation event. Each NCG 102 includes a series of N fire pulse groups (FPGs) 104, with each FPG 104 corresponding to a different one of the addresses of the set of addresses A1 to AN of a primitive. Although illustrated as being arranged sequentially from address A1 to AN, FPGs 104 may be arranged in any number of different orders.

Figure 6:
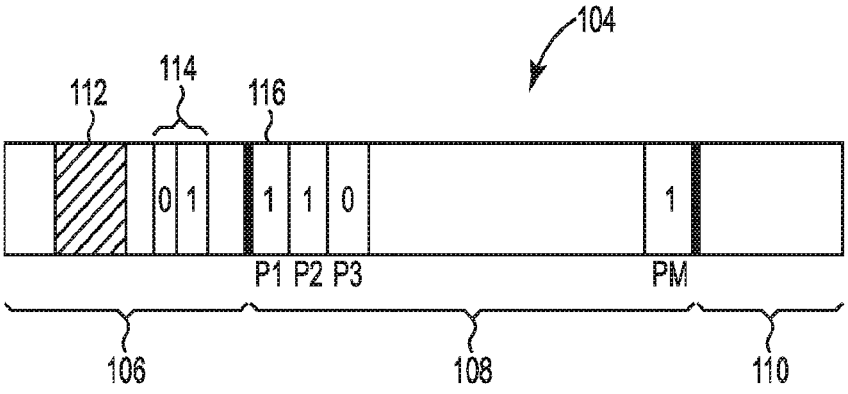
FIG. 6 is a block and schematic diagram generally illustrating an example fire pulse group.

FIG. 6 a block diagram generally illustrating a FPG 104, according to one example. FPG 104 includes a header portion 106, an actuation data portion 108, and a footer portion 110. According to one example, header portion 106 includes address bits 112 indicative of the address of the set of addresses A1 to AN to which the FPG corresponds. In one example, header portion 106 further includes one or more drop weight bits 114 indicative of a state to be employed for drop weight signals 34 and, thus, indicative of a drop weight to be employed by fluidic die 10 with regard to actuation data of actuation data portion 108. In one example, actuation data portion 108 includes a series of actuation bits 116, with each actuation bit 116 corresponding to a different one of the primitives P1 to PM, such that each actuation bit 116 corresponds to a nozzle 18 at the address represented by address bits 112 in a different one of the primitives P1 to PM.

With reference to FIG. 4, in operation, data parser 70 receives the series of NCGs 100 from controller 46. For each FPG 104 of each NCG 102, data parser 70 provides the address data 112 to address encoder 80, which encodes the corresponding address onto address bus 82, and provides the actuation bits to data buffer 84, which places each of the actuation bits 116 onto its corresponding data line D1 to DM, as indicated at 86. In one example, data parser 70 provides drop weight bits 114 to drop weight signal generator 74, which provides drop weight signals 34, such as drop weight signals DW1 and DW2, with either an enable state or a disable state based on the values of drop weight bits 114.

The encoded address on address bus 82 is provided to each address decoder 90-1 to 90-N of each primitive P1 to PM, with each of the address decoders 90 corresponding to the address encoded on bus 82 providing an active or "HI" output to the corresponding AND-gate 92. If the actuation data on the corresponding data line D1 to DM has an actuation value, the AND-gate 92 outputs a nozzle select signal 32 having a select value (e.g., a value of "1") to actuation logic 14. For example, if the encoded address from a received FPG 104 corresponds to address A2, address decoders 90-2 of each primitive P1 to PM provides a "HI" output to each corresponding AND-gate 92-2. If the actuation data on the corresponding data line D1 to DM has an actuation value, the AND-gate 92-2 outputs nozzle select signal 32-2 having a select value to actuation logic 14.

Actuation logic 14, in turn, such as described by FIG. 3, provides an actuation signal 36-2 having an actuation value to the corresponding nozzle 18-2 and/or to one or more neighboring nozzles 18 (e.g., nozzles 18-2, 18-3) based on states of drop weight signals 34 (e.g., one or more drop weight signals 34), so as to cause the target nozzle 18-2 and/or the one or more neighboring nozzles 18 (nozzles 18-1 and 18-3 (not illustrated) to eject fluid drops.

For instance, if data line D1 has an actuation bit having an actuation value, AND-gate 92-2 of nozzle 18-2 of primitive P1 provides a nozzle select signal 32-2 having a select value (e.g., a value of "1") to actuation logic 14. Based on the states of drop weight signals 34, such as DW1 and DW2, actuation logic 14, in-turn, provides an actuation signal 36-2 having an actuation value (e.g., a value of "1") to nozzle 18-2 and/or actuation signals 36-1 and 36-3 (not illustrated) having actuation values to neighboring nozzles 18-1 and 18-3 (not illustrated), such as described above by FIG. 3, to thereby eject fluid drops to form effective fluid drops a selected effective drop weight (e.g., $1^{st}$ drop weight, $2^{nd}$ drop weight, $3^{rd}$ drop weight, etc.).

As noted above, although illustrated in FIG. 4 as being disposed in a column and arranged in primitive groups, in other examples, nozzles 18 may be disposed in any number of suitable arrangements other than in columns or in primitives of fixed size. Similarly, any number of suitable addressing and data schemes other than that illustrated by FIG. 4 may be employed by fluid ejection system 100 and nozzle select logic 12 for selecting and providing actuation data to nozzles 18 of fluidic die 10. For instance, address data, actuation data, and drop weight data may be provided in forms other than FPGs 104. For example, in other implementations, address data may be internally generated by nozzle select logic 14, and drop weight data may be provided by controller to drop weight signal generator 74 via other communication paths, such as a communication path 73 (e.g., a serial I/O communication path).

Figure 7:
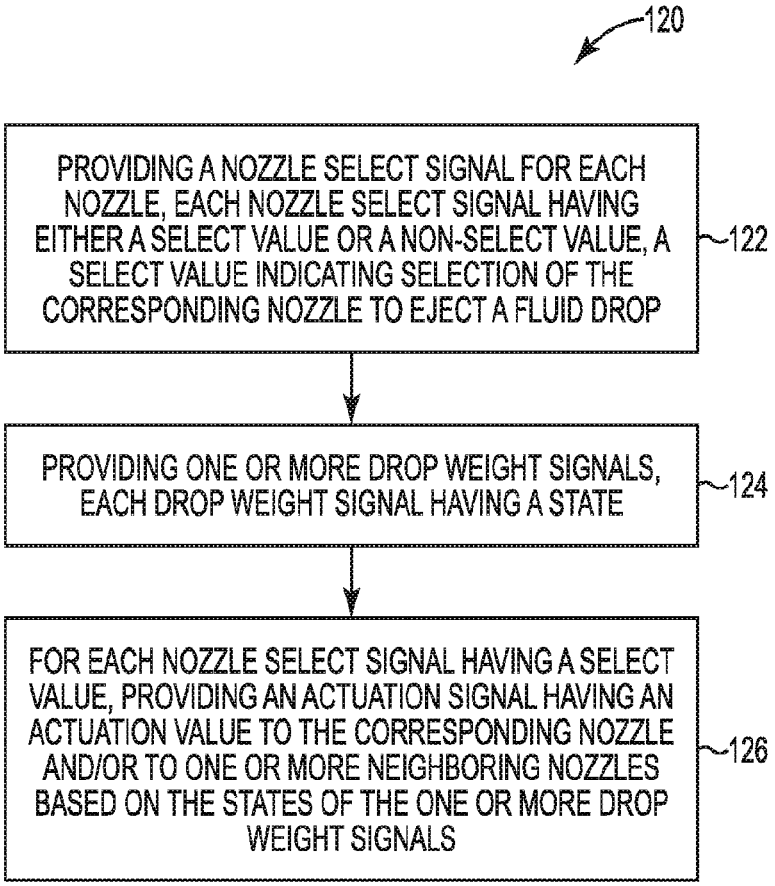
FIG. 7 is a flow diagram generally illustrating a method of operating a fluidic die, according to one example.

FIG. 7 is a flow diagram generally illustrating a method 120 of operating a fluidic die including an array of nozzles, such fluidic die 10 including an array 16 of nozzles 18 as illustrated by FIGS. 1-4, where each nozzle ejects a fluid drop in response to a corresponding actuation signal having an actuation value, such as nozzles 18 ejecting fluid drops in response to corresponding actuation signals 36 having actuation values, as illustrated by FIG. 1.

At 122, method 120 includes providing a nozzle select signal for each nozzle, each nozzle select signal having either a select value or a non-select value, where a select value indicates selection of the corresponding nozzle to eject a fluid drop, such as nozzle select logic 12 providing a nozzle select signal 32 corresponding to each nozzle 18, such as illustrated by FIGS. 1-4. In one example, a nozzle select signal has a select value when address data associated with the corresponding nozzle has an enable value and actuation data corresponding to the nozzle has an actuation value, such as nozzle select logic 12 providing nozzle select signals 32 corresponding to nozzles 18 based on address data and actuation data having an actuation value respectively being present on address bus 82 and data lines 86, as illustrated by FIG. 4.

At 124, one or more drop weight signals are provided, each drop weight signal having an enable or a disable state, such as drop weight signals DW1 and DW2 as illustrated by FIG. 3, for example. It is noted that the providing of drop weight signals may occur prior to the providing of nozzle select signals at 122.

At 126, method 120 includes, for each nozzle select signal having a select value, providing an actuation signal having an actuation value to the corresponding nozzle and/or to one or more neighboring nozzles based on the states of the one or more drop weight signals, such as actuation logic 14 providing an actuation signal 36 to nozzle N and/or providing actuation signals 36 to neighboring nozzles N−1 and N+1 based on the states of drop weight signals DW1 and DW2 as illustrated by FIG. 3. When more than a single drop of fluid is ejected by a combination of the corresponding nozzle (e.g., nozzle N in FIG. 3) and one or more neighboring nozzles (e.g., nozzles N and N+1 in FIG. 3), the ejected fluid drops merge, either in air or on a surface, to effectively form a single larger fluid drop.

Although specific examples have been illustrated and described herein, a variety of alternate and/or equivalent implementations may be substituted for the specific examples shown and described without departing from the scope of the present disclosure. This application is intended to cover any adaptations or variations of the specific examples discussed herein. Therefore, it is intended that this disclosure be limited only by the claims and the equivalents thereof.

The invention claimed is:

1. A fluidic die comprising:

an array of nozzles, each nozzle to eject a fluid drop in response to a corresponding actuation signal having an actuation value;

nozzle select logic to provide for each nozzle a nozzle select signal having a select value or a non-select value; and actuation logic to provide the respective actuation signal for each nozzle, the actuation logic to:

receive one or more drop weight signals; and for each nozzle select signal having the select value, to provide an actuation signal having an actuation value to the corresponding nozzle and/or to one or more neighboring nozzles based on a state of the one or more drop weight signals.

2. The fluidic die of claim 1, the nozzles of the array of nozzles arranged in a column, the neighboring nozzles comprising nozzles adjacent to the corresponding nozzle.

3. The fluidic die of claim 1, each nozzle of the array of nozzles to eject a fluid drop of a same drop weight.

4. The fluidic die of claim 1, the corresponding nozzle and the one or more neighboring nozzles disposed relative to one another such that fluid drops ejected by the corresponding nozzle and the one or more neighboring nozzles merge to have an effect of a larger fluid drop.

5. The fluidic die of claim 1, the nozzle select logic to:

receive actuation data, the actuation data including actuation data bits, each actuation data bit corresponding to a different one of the nozzles and having an actuation value or a non-actuation value, each nozzle further having corresponding address data having an enable value or a non-enable value; and provide, for each nozzle, a nozzle select signal having the select value when the corresponding actuation data bit has the actuation value and the corresponding address data has the enable value.

6. The fluidic die of claim 1, the nozzles of the array arranged to form primitives.

7. The fluid die of claim 1, the fluidic die comprising a printhead.

8. The fluidic die of claim 1, the corresponding nozzle and the one or more neighboring nozzles disposed relative to one another such that fluid drops ejected by the corresponding nozzle and the one or more neighboring nozzles merge to have an effect of a larger fluid drop.

9. A fluid ejection system comprising:

a controller providing actuation data including actuation data bits and drop weight signal data; and a fluidic die including:

an array of nozzles, each nozzle to eject a fluid drop in response to a corresponding actuation signal having an actuation value;

nozzle select logic receiving the actuation data bits, one actuation data bit corresponding to each nozzle and having an actuation value and a non-actuation value, and having address data corresponding address data for each nozzle having an enable value or a non-enable value, the nozzle select logic to provide for each nozzle a nozzle select signal having a select value when the corresponding actuation data bit has the actuation value and the corresponding address data has the enable value;

a drop weight signal generator providing one more drop weight signals each having a state based on the drop weight data; and actuation logic to provide the respective actuation signal for each nozzle, for each nozzle select signal having the select value, to provide an actuation signal having an actuation value to the corresponding nozzle and/or to one or more neighboring nozzles based on a state of the one or more drop weight signals.

10. The fluid ejection system of claim 9, the nozzles of the array of nozzles arranged in a column, the neighboring nozzles comprising nozzles adjacent the corresponding nozzle.

11. The fluid ejection system of claim 9, each nozzle of the array of nozzles to eject a fluid drop of a same drop weight.

12. A method of operating a fluidic die including an array of nozzles, each nozzle to eject a fluid drop in response to a corresponding actuation signal having an actuation value, the method comprising:

providing a nozzle select signal for each nozzle, each nozzle select signal having either a select value or a non-select value, a select value indicating selection of the corresponding nozzle to eject a fluid drop;

providing one or more drop weight signals, each drop weight signal having a state;

for each nozzle select signal having a select value, providing an actuation to having an actuation value to the corresponding nozzle and/or to one or more neighboring nozzles based on the states of the one or more drop weight signals.

13. The method of claim 12, including:

ejecting a fluid drop of a same drop weight from each nozzle of the array.

14. The method of claim 12, including:

disposing the nozzles of the array relative to one another such that fluid drops ejected by the corresponding nozzle and/or one or more neighboring nozzles merge to have an effect of a single larger fluid drop.

15. The method of claim 12, including:

changing states of the one or more drop weights to select a number of nozzles from the corresponding nozzle and the one or more neighboring nozzles to which actuation signals having the actuation value will be provided to select an effective drop weight of fluid to be ejected for each nozzle select signal having a select value.

* * * * *